US005318942A

United States Patent [19]

Laudy

[11] Patent Number: 5,318,942

[45] Date of Patent: * Jun. 7, 1994

[54] ELASTIC MEMBER FOR FACILITATING SUBLISTATIC PRINTING

[76] Inventor: Roger K. Laudy, 1808 Ramhurst Dr., Winston-Salem, N.C. 27103

[ * ] Notice: The portion of the term of this patent subsequent to Feb. 5, 2008 has been disclaimed.

[21] Appl. No.: 836,744

[22] Filed: Feb. 19, 1992

Related U.S. Application Data

[63] Continuation of Ser. No. 439,213, Nov. 20, 1989, abandoned.

[51] Int. Cl.[5] ..... B41M 5/035; B41M 5/38

[52] U.S. Cl. ..... 503/227; 428/195; 428/913; 428/914

[58] Field of Search ..... 8/471; 428/195, 913, 428/914; 503/227; 101/9, 33-35, 38.1, 39, 40, 488

[56] References Cited

U.S. PATENT DOCUMENTS 4,923,848 5/1990 Akada et al. ..... 503/227
4,989,508 2/1991 King ..... 101/35

*Primary Examiner*—B. Hamilton Hess

[57] ABSTRACT

An elastic member is used to hold a sublistatic transfer sheet securely in place against the arcuate surface of an article to be imprinted.

3 Claims, 1 Drawing Sheet

ELASTIC MEMBER FOR FACILITATING SUBLISTATIC PRINTING

This application is a continuation application of my earlier application entitled ELASTIC MEMBER FOR FACILITATING SUBLISTATIC PRINTING, Ser. No. 439,213, which was filed Nov. 20, 1989, now abandoned.

BACKGROUND OF THE INVENTION

1. Field of the Invention

The present invention concerns an elastic member for holding a sublistatic transfer sheet securely in place against the arcuate surface of an article to be imprinted.

2. Background of the Invention

Sublistatic printing is the technique of first placing a due in the proper form and color on a vehicle, for example, a piece of paper conveniently referred to as a transfer sheet. The dye has special qualities that allow its ingredients to convert from a solid particle to a gas without going through a liquid phase. The conversion is usually initiated by the application of heat. Sublistatic printing requires intimate contact between the transfer sheet on which the design is printed and the surface of the article to be imprinted. Full details of the sublistatic printing process are set forth in U.S. Pat. No. 4,246,331, the contents of which are incorporated herein. A full discussion of the use of the present invention is disclosed in co-pending application Ser. No. 07/439,051 entitled Device for Facilitating Sublistatic Printing, the contents of which are incorporated herein by reference.

SUMMARY OF THE INVENTION

It is an object of the present invention to provide a flexible member that will function to apply a uniform and perpendicular pressure against a sublistatic transfer sheet intimately contacting a generally arcuate surface of an article to be imprinted.

It is a further object of the present invention to provide one or more specific configurations of an elastic member to facilitate sublistatic printing that is suitable for use in imprinting generally arcuate surfaces of cups, dishes, bowls, mugs, glasses and the like.

It is yet a further object of the present invention to provide an elastic member in the form of an elastic band that may be utilized in conjunction with a variety of installation devices to place the band around an arcuate surface and hold a transfer sheet intimately against that surface for sublistatic printing.

The elastic member comprising the present invention is preferably formed of a relatively thin section of rubber and is of a sufficient length and width to cover the arcuate surface of the article to be imprinted while in the stretched condition. The member, in the form of the band, has band ends that can be secured to hold the band against the transfer sheet and surface to be imprinted. The band ends secure the band around the transfer sheet and urge it intimately in contact with the surface to be imprinted.

The objectives of the present invention will become clearer after consideration of the following detailed specification taken in conjunction with the accompanying drawings wherein like characters of reference designate like parts throughout the several views.

DETAILED DESCRIPTION OF THE INVENTION

Figure 1:
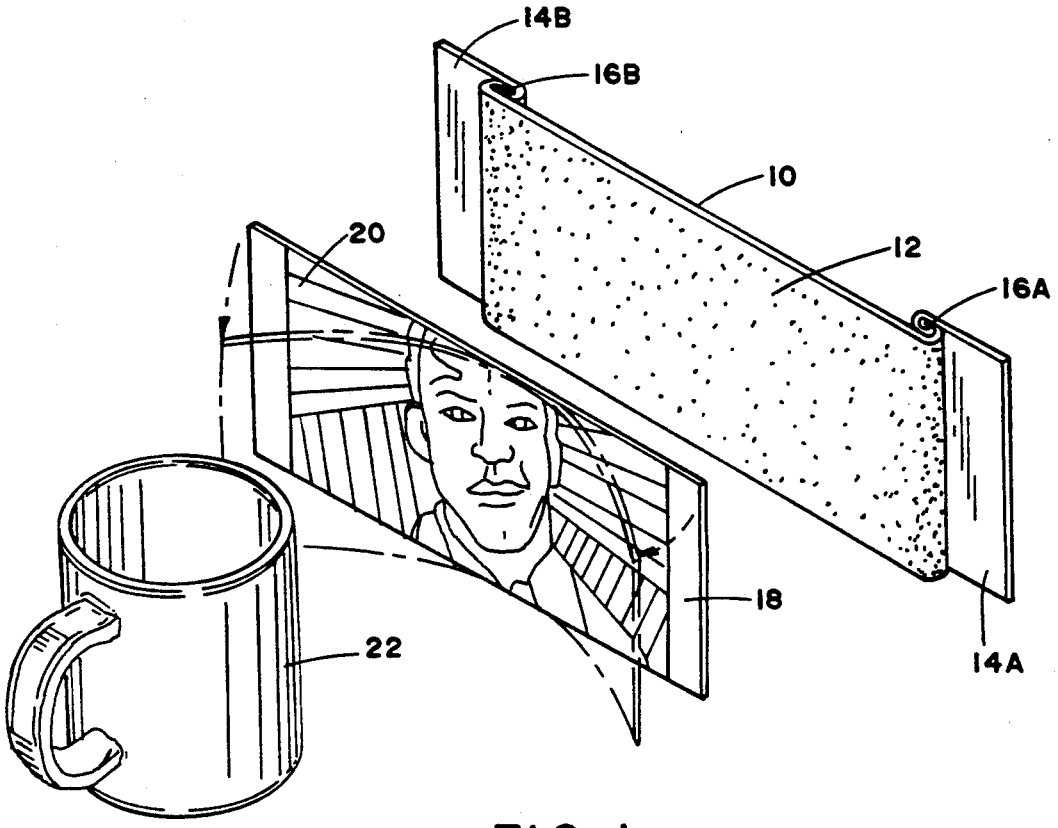
FIG. 1 is a perspective view of an elastic article in the form of a flexible band made in accordance with the present invention, a sublistatic transfer sheet containing a selected design, and a coffee mug, the surface of which is to be imprinted with the design.

Referring now to the drawings, an elastic member, one embodiment of which is shown as an elastic band 10, is illustrated in FIG. 1. Band 10 has an elastic portion 12 usually formed of rubber and more preferably fabricated from silicon rubber. It has been found that silicon rubber with a durometer of shore A50, a tensile strength of approximately 1,200 psi, an elongation potential of 600% and a thickness of approximately 0.062 inches performs in an outstanding manner to effect sublistatic printing on generally arcuate surfaces. These parameters may be individually or group varied and can be adjusted in accordance with the characteristics of heat, dye or transfer paper used during the sublistatic printing process. Elastic portion 12 is relatively thin and therefore does not interfere with the heat transfer that is required to effectively initiate and effect sublistatic printing. The rubber material should be able to withstand temperatures up to approximately 210 degrees Centigrade, the temperature usually required for sublistatic printing.

At each end of the elastic portion 12 are band ends 14*a*, 14*b*. These are secured to portion 12 utilized to be clasped to elongated band 10 by a suitable engaging means. The ends 14*a*, 14*b* may be formed from a metal such as aluminum and are shaped near their connection with portion 12 by crimping to form an engagable curve.

Figure 2:
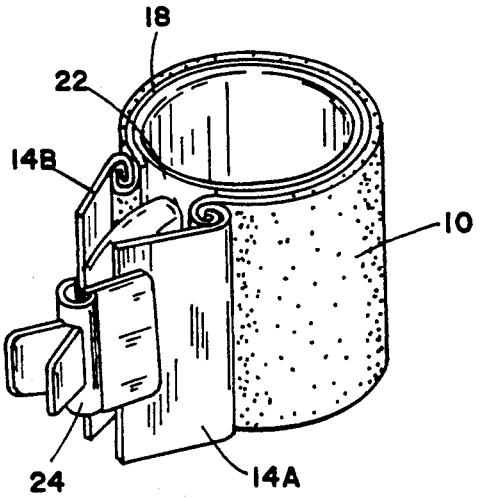
FIG. 2 is a perspective view of the elastic member comprising the present invention in the form of the flexible band shown in FIG. 1 wrapped around the transfer sheet and the coffee mug, both also shown in FIG. 1.

In FIG. 2, band 10 has been stretched and wrapped around transfer sheet 18 and mug 22. Rigid ends 14*a*, 14*b* are joined by clamp 24 so that band 10 exerts a uniform pressure of approximately 2 to 5 psi perpendicularly (radially) against sheet 18 and mug 22 to ensure intimate contact between sheet 18 and mug 22 and, the resulting positive printing in surface areas of imperfection such as depressions, ridges, grooves or other irregularities. Such irregularities occur even though the forms in which items such as mugs are cast are accurately machined, because the soft clay used in the formation of the mug tends to slump and deform slightly before it can harden.

Figure 3:
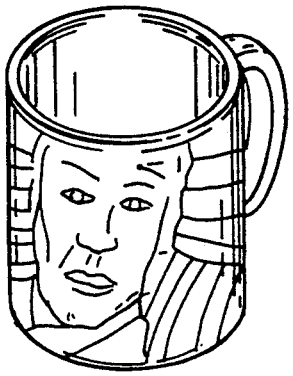
FIG. 3 is a perspective view of the mug shown in FIG. 1 whose surface now carries the design shown on the transfer sheet also shown in FIG. 1.

The band-wrapped article shown in FIG. 2 can be heated in a suitable heating device such as an oven at a temperature of from 120 degrees to 250 degrees Centigrade for a period of from 30 seconds to 6 minutes in order to cause sublistatic printing of design 20 on the surface of mug 22. The printed mug is shown in FIG. 3.

Obviously the elastic member comprising the present invention can take any form so long as its size is sufficient to effectively cover the surface of the article to be imprinted and hold a transfer sheet under uniform pressure and in intimate contact with that surface. The member may be a band as described in the embodiment set forth herein or any other usable configuration like a circle, diamond, parabola or square. It can carry its own elements for making a positive connection to the surface to hold the transfer sheet in place or it can cooperate with a separate and unrelated element to be gripped or held thereby so as to keep it in positive engagement with a transfer sheet against the surface to be imprinted.

It is to be understood that the form of the invention herewith shown and described is to be taken as an illustrative embodiment only and that various changes in the shape, size and arrangement of parts may be made without departing from the spirit and purpose of the invention.

What is claimed as being new and what is desired to be protected by Letters Patent of the United States is as follows.

1. An assembly for conducting sublistatic printing comprising: an article having an arcuate surface to be sublistatically imprinted; a sublistatic transfer sheet positioned against the article arcuate surface; and an elastic member holding the transfer sheet against the article arcuate surface, the elastic member having an elastic band with first and second ends and means associated with the elastic band to enable the releasable securement of the elastic member to the transfer sheet around the article arcuate surface, whereby the elastic band is stretched prior to engaging the transfer sheet positioned against the article arcuate surface and thereafter applied to the transfer sheet around the article arcuate surface to exert uniform perpendicular forces against the transfer sheet and article arcuate surface.

2. The assembly as claimed in claim 1 wherein the securement means has termination means at each of the elastic band ends.

3. The assembly as claimed in claim 2 wherein the termination means includes rigid band ends and a clamp securing the rigid band ends.

* * * * *